United States Patent [19]

Riordan

[11] Patent Number: 4,682,938

[45] Date of Patent: Jul. 28, 1987

[54] GEAR PUMP BEARINGS

[75] Inventor: R. Michael Riordan, Rockford, Ill.

[73] Assignee: Sundstrand Corporation, Rockford, Ill.

[21] Appl. No.: 813,591

[22] Filed: Dec. 26, 1985

[51] Int. Cl.[4] ..... F04C 2/18; B23P 13/04; B23P 15/14

[52] U.S. Cl. ..... 418/1; 418/131; 418/206; 29/156.4 R; 29/557

[58] Field of Search ..... 418/1, 131, 132, 134, 418/135, 205, 206; 29/156.4 R, 557

[56] References Cited

U.S. PATENT DOCUMENTS

| | | | |
|---|---|---|---|
| 384,504 | 6/1888 | Braman . | |
| 1,853,727 | 4/1932 | Franks . | |
| 2,123,754 | 7/1938 | Talbot . | |
| 2,332,232 | 10/1943 | Kauffman, 2nd . | |
| 2,823,615 | 2/1958 | Haberland . | |
| 2,870,719 | 1/1959 | Murray et al. . | |
| 2,900,920 | 8/1959 | Compton | 418/131 |
| 2,972,959 | 2/1961 | Wilson et al. . | |
| 3,574,492 | 4/1971 | Schwary . | |
| 3,602,616 | 8/1971 | Jung . | |
| 3,993,369 | 11/1976 | McCloskey . | |
| 4,124,335 | 11/1978 | Jons et al. . | |
| 4,248,486 | 2/1981 | Bradley, Jr. . | |
| 4,336,006 | 6/1982 | Grabow et al. . | |
| 4,395,207 | 7/1983 | Manttari et al. | 418/131 |

FOREIGN PATENT DOCUMENTS

| | | | |
|---|---|---|---|
| 2552528 | 5/1977 | Fed. Rep. of Germany | 418/131 |
| 55-91785 | 7/1980 | Japan | 418/131 |

*Primary Examiner*—John J. Vrablik

*Attorney, Agent, or Firm*—Wood, Dalton, Phillips, Mason & Rowe

[57] ABSTRACT

Variations in pump capacity of gear pumps due to varying leakage paths occurring in otherwise identical pumps as a result of the manufacturing operation are minimized without unduly hindering the fitting of the bearings through the pump housing by maintaining the distance "TBD" between the center of the bearing journal and the bearing flat closely within tolerances and by providing a relief in the bearing periphery diametrically opposite of the flat.

7 Claims, 8 Drawing Figures

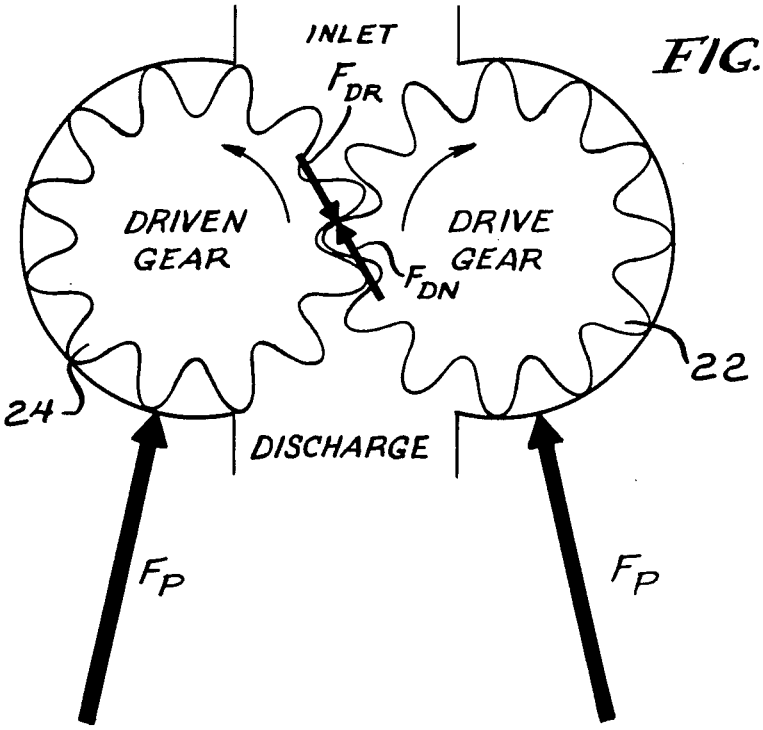
FIG. 5
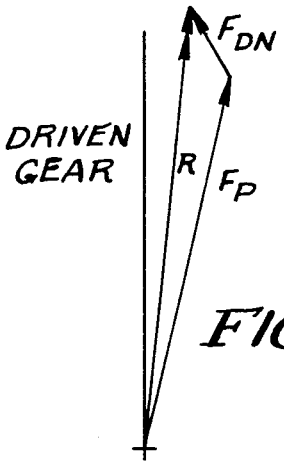
FIG. 6
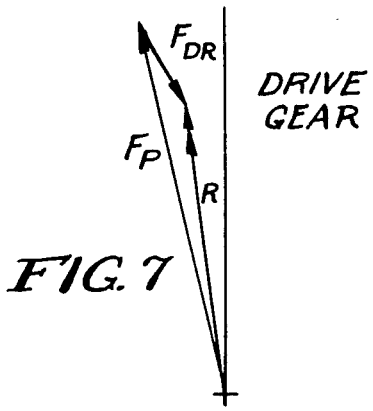
FIG. 7
FIG. 8
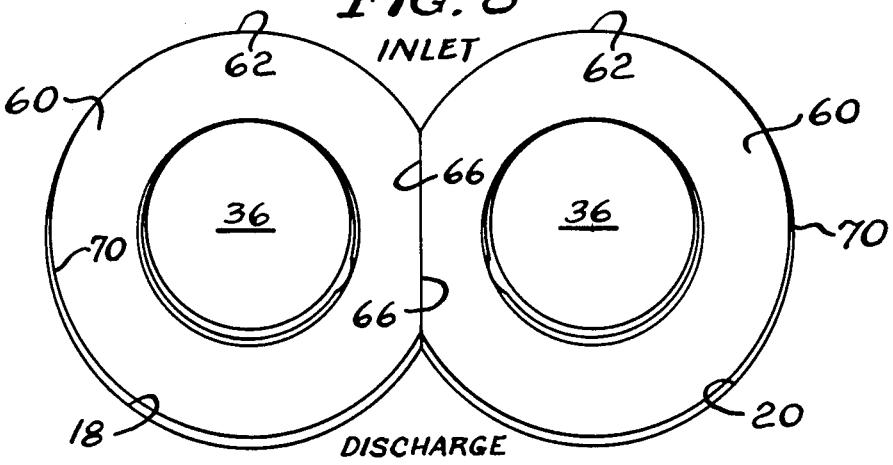

GEAR PUMP BEARINGS

TECHNICAL FIELD

This invention relates to gear pumps, and more specifically, to gear pumps having improved bearing constructions and methods of making the same.

BACKGROUND OF THE INVENTION

Gear pumps have long been used as positive displacement pumps in a variety of applications with considerable success. As is well known, they typically include a housing having an interior chamber defined by parallel, intersecting, cylindrical bores. A spur gear is disposed in each of the bores along with an associated shaft and the gears mesh in the area of intersection of the bores. Bearings are also disposed in the bores to journal the shafts, and in the usual case, have a generally cylindrical exterior configuration with facing and engaging flats immediately adjacent to the point at which the gears mesh.

On one side of such point, the housing is provided with an outlet, while on the other side, the housing is provided with an inlet.

The gears are driven to rotate in such a way that they unmesh adjacent the inlet to pick a fluid and convey the same around the periphery of the bores to the point at where they mesh. The meshing of the gears forces the fluid out of the space between the individual teeth on the respective gears and out of the outlet.

One persistent difficulty results as a consequence of this basic design. The pressure of the fluid being pumped is greater adjacent the outlet than at the inlet during pump operation. As a consequence, the gears and their shafts are side-loaded, that is, subjected to a force that is generally transverse to the rotational axes of the shafts and generally in the direction from the outlet toward the inlet. Other lesser, but nonetheless significant, forces are present as, for example, those resulting from interengagement of the gear teeth during operation.

The pressure differential causes leakage flow from the outlet to the inlet through the interfaces of the various components which lowers the efficiency of the pump during operation. In general, leakage flow is a very small percentage of the total flow and itself may not be a significant problem. However, in many instances, there are substantial variations in the leakage flow from one identically made pump to another. Even more importantly, the depth of mesh of the spur gears may vary substantially in obtensibly identical pumps. Since the volume pumped is a direct function of the volume displaced by the meshing gears, variation in depth of mesh will greatly affect capacity. This in turn requires all pumps of a particular type to be built somewhat over capacity in order to insure that the "worst case" pump meets capacity specifications.

A substantial factor resulting in differing capacities in otherwise identical pumps is the fact that conventionally, the bearings are sized to fit the pump chamber. In the usual case, the bearings are manufactured paying close heed to the design dimension between the center of the flat and the diametrically opposite side of the otherwise cylindrical bearing. In order to minimize leakage paths, such bearings are made to relatively tight fit within respective bores in the pump and not infrequently, due to tolerance variations, good fitting cannot always be attained. Thus, it has been customary to, during the assembly process, shave material off of the flats of one or more of the bearings in the hope that a good fit can be achieved. Indeed, the bearings are designed to be shaved so as to accommodate tolerance variation while attempting to maintain a tight fit.

However, in the shaving process, parallelism of the face of the flat to the axial center line of the bearing may be lost, creating a leakage path. Alternatively, the flatness of the face can be lost during the shaving process, again creating a leakage path across the flats. Further, shaving may result in a loss of squareness of the face of the flat to the end of the bearing which in turn may not seal properly against the housing end wall or which may prevent the bearing from moving properly in response to shaft deflection during operation. Most significantly, shaving will result in a changed depth of mesh of the gears journalled by the bearings and accordingly alter the pump's capacity.

The present invention is directed to overcoming one or more of the above problems.

SUMMARY OF THE INVENTION

It is the principal object of the invention to provide a new and improved gear pump. More specifically, it is an object of the invention to provide a new and improved bearing construction for gear pumps. It is also an object of the invention to provide a new and improved method for making gear pumps with improved bearings.

According to one aspect of the invention, there is provided a gear pump with a housing including an interior pumping chamber configured as a pair of intersecting cylindrical bores. An inlet and an outlet are provided to the chamber, and a pair of meshed gears are disposed in the chamber, with each gear being disposed on an associated shaft. Bearings are located in the chamber and journal the shafts. The bearings are generally cylindrical with facing and engaging flats located adjacent the area in which the gears are meshed and the interfaces of the bearings and the bores opposite the flats are slightly relieved along their entire axial length.

This allows the bearings to be fitted to the chamber without shaving of the flats, thereby avoiding the leakage paths that come into existence as a result of such shaving.

In the preferred embodiment, the reliefs are in the form of crescents when viewed in section. A highly preferred embodiment contemplates that the reliefs be formed on the bearings themselves, diametrically opposite of the flats.

The reliefs are uniform along the length of the respective bearings in a preferred embodiment of the invention and are defined by the surface of a cylinder whose center is displaced toward the flat of the associated bearing from the center of the associated bearing and whose radius is greater than the radius of the associated bearing.

According to another facet of the invention, there is provided a method of making a gear pump of the type having a housing with an interior chamber defined by two intersecting cylindrical bores whose axes are parallel and which are to respectively receive (a) one each of a pair of meshed gears, with each gear having an associated shaft, and (b) a cylindrical bearing for each associated shaft with the bearings for the shafts having facing and engaging flats adjacent the area at which the gears mesh. The method includes the steps of closely maintaining to a desired tolerance, the distance between the flat of each bearing and the rotational axis for the shaft defined by the bearing, and providing such reliefs as may be required to fit the gears, bearings and shafts to the chamber, the reliefs being disposed at the interfaces of the bores and the bearings remote from the flats. Preferably, the step of providing the reliefs is performed on the bearings.

Other objects and advantages will become apparent from the following specification taken in connection with the accompanying drawings.

DESCRIPTION OF THE DRAWINGS

FIG. 5 is a somewhat schematic view illustrating forces existent during operation of a typical gear pump;

FIG. 6 is a vector diagram illustrating the forces existing in the driven gear in a gear pump;

FIG. 7 is a view similar to FIG. 6 but illustrating, in vector form, the forces existing in the drive gear of a gear pump; and FIG. 8 is a somewhat schematic view of the disposition of the bearings in a gear pump made according to the invention during operation thereof.

DESCRIPTION OF THE PREFERRED EMBODIMENT

Figure 1:
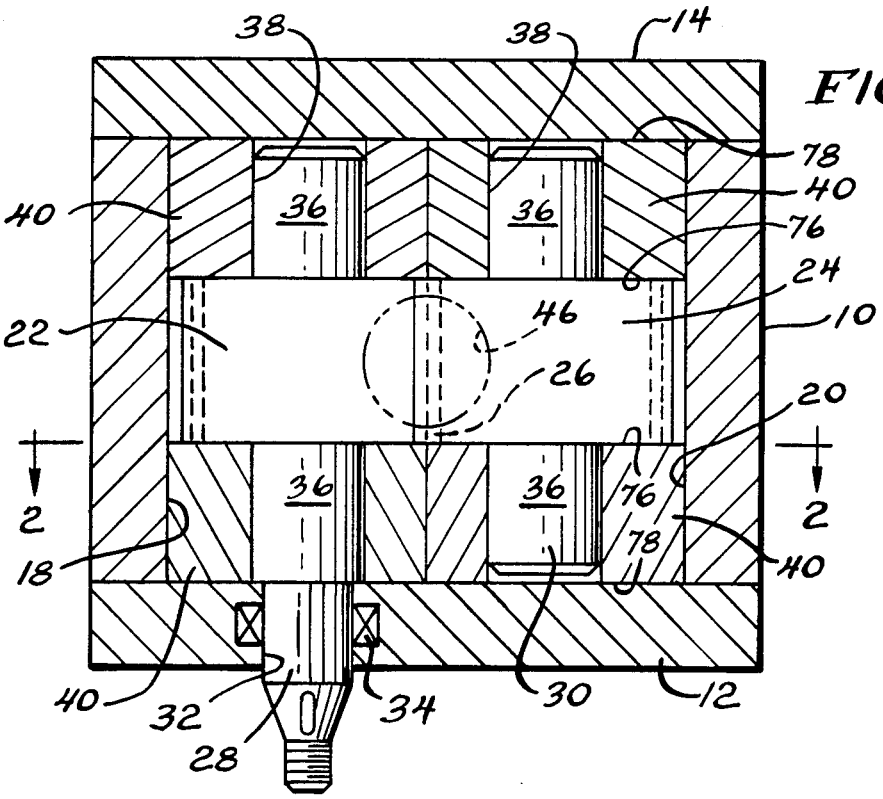
FIG. 1 is a sectional view of a gear pump which may embody the invention.
Figure 2:
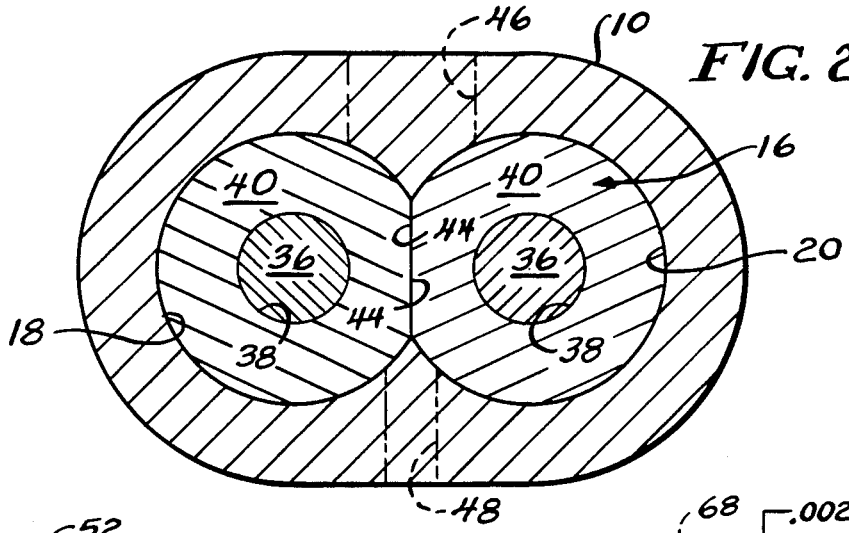
FIG. 2 is a sectional view taken approximately along line 2—2 in FIG. 1.

An exemplary embodiment of a gear pump in which the invention may be embodied is illustrated in FIGS. 1 and 2 and with reference thereto, is seen to include a central housing 10 flanked by caps or end plates 12 and 14. As best seen in FIG. 2, the housing 10 includes a chamber, generally designated at 16, defined by two parallel, intersecting, cylindrical bores 18 and 20.

The pump includes two gears 22 and 24 disposed within the chamber 16 and, more specifically, within the bores 18 and 20, respectively so as to be meshed generally in the vicinity of a dotted line designated 26 in FIG. 1.

The gear 22 is disposed on or integral with a drive shaft 28 while the gear 24 is mounted on or integral with a shaft 30. The drive shaft 28 extends through an opening 32 in the end plate 12 to be connected to any source of rotational energy, and a seal 34 is provided as indicated.

Within the housing 10, both of the shafts 28 and 30 have oppositely directed journal surfaces 36 which are journalled in cylindrical bores 38 in respective bearings 40.

As best seen in FIG. 2, for most of their periphery, the bearings 40 are cylindrical about the rotational axis of the shafts 36 defined by the bores 38. However, immediately adjacent the point 26 whereat the gears 22 and 24 mesh, each of the bearings 38 is provided with a flat 44. The flats 44 on adjacent bearings 40 face each other and are engaged with each other. The flats 44 are intended to be defined by planes parallel to the center line of the bores 38.

The housing 10 is provided with an inlet port 46 opening to the point 26 whereat the gears 22 and 24 mesh. Similarly, the housing 10 includes an outlet port 48 extending from the same location.

Figure 3:
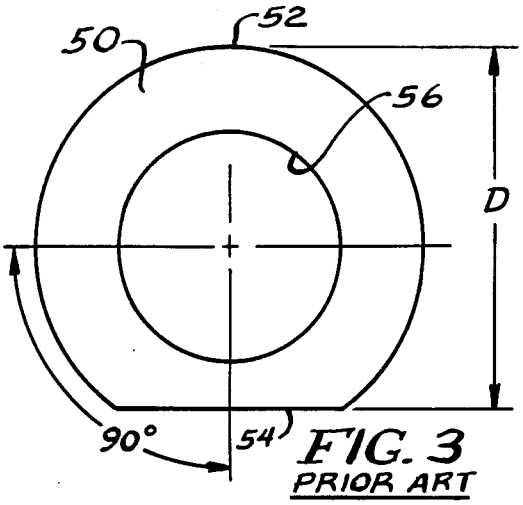
FIG. 3 PRIOR ART
FIG. 3 is a somewhat schematic, elevational view of a bearing made according to the prior art.

With reference now to FIG. 3, a prior art method of assembly of a gear pump, such as that just described and alluded to previously will be described. The prior art bearing is designated 50 and includes a generally cylindrical periphery 52 with a flat 54 on one side thereof. A cylindrical bore 56 to provide a journal for the shafts in the gear pump is also provided.

In the manufacture of such bearings 50, according to the prior art, the controlled tolerance is that shown by the dimension "D" in FIG. 3, that is, the distance from the flat 54 to a diametrically opposite point on the periphery 52 of the bearing 50. It can be appreciated that when, according to prior art assembly technique, the flat 54 is shaved so as to allow the bearing 50 to be fitted to a pump housing, the control of this tolerance is lost to some degree during the shaving process.

Figure 4:
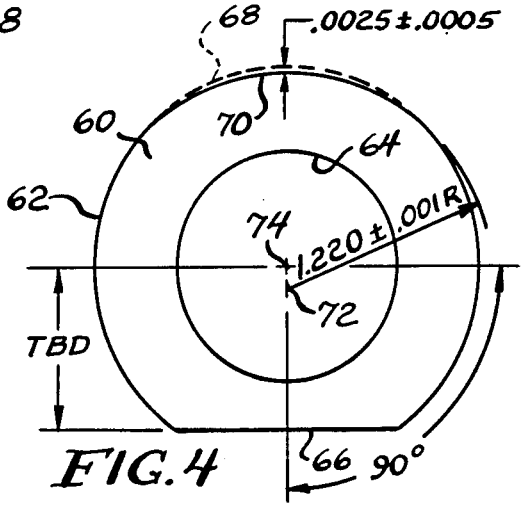
FIG. 4 is a view similar to FIG. 3 but of a bearing made according to the invention.

FIG. 4 illustrate a similar bearing made according to the invention. It is designated 60 and includes a generally cylindrical outer periphery 62 with a central bore 64 for journalling one of the shafts. Also included is a flat 66.

According to the invention, the closely controlled tolerance is that shown by the dimension "TBD" which is the distance from the center of the bore 64 to the center of the flat 66. In assembling a pump utilizing a bearing 60, no shaving is performed on the flat 66 so the dimension "TBD" can be closely held, which in turn, allows the gears 22 and 24 to properly mesh in every instance within the tolerances of the components involved.

To assure that the bearing 60 can be fitted to the housing, it is frequently desirable to provide a relief at the interface with a bore such as the bore 18 or the bore 20 in the housing 10. In FIG. 4, a continuation of the cylindrical periphery of the bearing 60 at a location diametrically opposite the flat 66 is shown by a dotted line 68 whereas the actual surface of the bearing 60 at such location after the forming of the relief is shown at 70. Consequently, a thin crescent shaped (as viewed in cross-section) relief exists and is bounded by the lines 68 and 70 as viewed in FIG. 4. Preferably, the relief surface 70 is formed as the surface of a cylinder, whose center 72 is displaced toward the flat 66 from the center 74 of the bearing 60, and is otherwise parallel thereto. In addition, the radius of the cylinder forming the surface 70 is somewhat greater than the radius of the cylinder defining the surface 62, 68. In an embodiment of a gear pump intended for use as a fuel pump in an aircraft, dimensions and tolerances such as indicated in FIG. 4 may be utilized.

Because the flats 66 on bearings 60 utilized in gear pumps made according to the invention do not require shaving during assembly, the loss of parallelism of the flat to the center line of the bearing, or the loss of flatness, or the loss of squareness of the flat to faces 76 or 78 (FIG. 1) of the bearings does not occur. As a result, the forces acting within the gear pump during operation provide significantly improved sealing and reduce leakage and leakage variation from one pump to another.

FIG. 5 illustrates the principal forces acting on the gear pump during its operation. The forces designated "$F_p$" act generally on the gears 22 and 24 in the direction of the arrows indicated in FIG. 5 and are generated by the pressure differential from the discharge or outlet to the inlet. At the same time, forces shown at "$F_{dr}$" and "$F_{dn}$" act between the gear teeth at the point of engagement as a result of the drive gear 22 driving the driven gear 24.

FIGS. 6 and 7 respectively illustrate a vector resolution of such forces on the driven gear and the drive gear respectively, and it will be observed that the resultant force "R" in both cases is tending somewhat to drive the two gears 22 and 24 towards each other. This loading on the gears will be placed on the shafts 28 and 30 and in turn conveyed through their journals 36 to the bearings 40. Where the bearings 40 are constructed according to the invention, that is as the bearings 60, they will be driven into contact across the entire area of their flats 66. Since parallelism to the transverse centerline of each flat is maintained, as well as the flatness thereof, there will be no irregularities resulting in the formation of leakage paths and the involved forces effectively seal the bearings to each other. Though not apparent from the diagrams shown in FIGS. 5–7 inclusive, the fact that squareness of the flats 66 to the faces 76 and 78 is maintained tends to assure that such end faces will not be skewed with respect to the sides of the gears 22 or 24 or the internal surfaces of the end caps 12 and 14 to provide good sealing at those locations as well.

The general configuration of the components during operation is illustrated in FIG. 8 and it will be appreciated that the truly cylindrical periphery 62 of each bearing 60 will be in good sealing engagement with the respective bores 18 and 20 adjacent the inlet to avoid leakage about the peripheries of the bearings.

Mathematical analysis has shown that by utilizing bearings made according to the invention in gear pumps, the variation in pump capacity due to varying leakage paths or depth of mesh in otherwise identical pumps is reduced by slightly more than two-thirds. This considerable improvement is obtained through the use of excellent control over the dimension from the center of the bearing journal through the center of the flats.

I claim:

1. In a method of making a gear pump having a housing with an interior chamber defined by two intersecting cylindrical bores whose axes are parallel and which are to respectively receive (a) one of a pair of meshed gears, with each gear having an associated shaft, and (b) a cylindrical bearing for the associated shaft with the bearings for the shafts having facing and engaging flats adjacent the area at which the gears mesh, the steps of:

closely maintaining to a desired tolerance the distance between the flat of each bearing and the rotational axis for the shaft defined by the bearing; and providing such reliefs only diametrically opposite said flats as may be required to fit said gears, bearings and shafts to said chamber at the interfaces of said bores and said bearings remote from said flats.

2. The method of claim 1 wherein the the step of providing is performed on said bearings.

3. A gear pump comprising:

a housing including an interior pumping chamber configured as a pair of intersecting cylinders;

an inlet to said chamber;

an outlet from said chamber and spaced from said inlet;

a pair of meshed gears in said chamber, each gear disposed on an associated shaft; and means for preventing fluid leakage including bearings in said chamber journalling said shafts, said bearings being generally cylindrical with facing and engaging flats disposed adjacent the area in which said gears are meshed, said bearings being slightly relieved, said relief occurring only at the sides of said bearings located diametrically opposite said flats, and occurring generally uniformly along the length of the respective bearing so that said bearings may be fitted to said chamber without shaving said flats.

4. The gear pump of claim 3 wherein the reliefs on said bearings are generally crescent shaped in cross section.

5. The gear pump of claim 3 wherein the reliefs are defined by a surface of a cylinder whose center is displaced toward the flat of the associated bearing from the center of the associated bearing and whose radius is greater than the radius of the outer periphery of the associated bearing.

6. A gear pump comprising:

a housing including an interior pumping chamber configured as a pair of intersecting cylindrical bores;

an inlet to said chamber;

an outlet from said chamber and spaced from said inlet;

a pair of meshed gears in said chamber, each gear disposed on an associated shaft; and means for preventing fluid leakage including bearings in said chamber journalling said shafts, said bearings being generally cylindrical with facing and engaging flats disposed adjacent the area in which said gears are meshed, said bearings and said bores being slightly relieved, said relief occurring only at the interfaces of said bearings and said bores located diametrically opposite of said flats, along their entire axial length so that said bearings may be fitted to said chamber without shaving said flats.

7. The gear pump of claim 6 wherein the reliefs are in the form of thin crescents when viewed in section.

* * * * *